US006729946B2

(12) United States Patent
Kimura

(10) Patent No.: US 6,729,946 B2
(45) Date of Patent: May 4, 2004

(54) POLISHING APPARATUS

(75) Inventor: Norio Kimura, Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 477 days.

(21) Appl. No.: 09/834,927

(22) Filed: Apr. 16, 2001

(65) Prior Publication Data

US 2001/0039172 A1 Nov. 8, 2001

(30) Foreign Application Priority Data

Apr. 17, 2000 (JP) ..... 2000/115423

(51) Int. Cl.[7] ..... B24B 29/00
(52) U.S. Cl. ..... 451/388; 451/289
(58) Field of Search ..... 451/259, 285–289, 451/388; 156/345.12, 345.13, 345.14

(56) References Cited

U.S. PATENT DOCUMENTS 5,423,558 A * 6/1995 Koeth et al. ..... 279/3
5,733,182 A * 3/1998 Muramatsu et al. ..... 451/289
5,916,015 A * 6/1999 Natalicio ..... 451/288
5,916,412 A 6/1999 Nakashiba et al.
5,985,094 A * 11/1999 Mosca ..... 156/345.14
6,030,275 A * 2/2000 Lofaro ..... 451/5
6,033,520 A 3/2000 Kimura et al.
6,106,379 A * 8/2000 Mosca ..... 451/288
6,168,684 B1 * 1/2001 Mitsuhashi et al. .... 156/345.14
6,358,129 B2 * 3/2002 Dow ..... 451/285
6,435,956 B1 * 8/2002 Ohwada et al. ..... 451/289
6,447,379 B1 * 9/2002 Gromko et al. ..... 451/287
6,572,462 B1 * 6/2003 Vanell ..... 451/287

FOREIGN PATENT DOCUMENTS

JP 2-98926 4/1990
JP 11-179652 7/1999

* cited by examiner

*Primary Examiner*—Lee D. Wilson
*Assistant Examiner*—David B. Thomas
(74) *Attorney, Agent, or Firm*—Wenderoth, Lind & Ponack, L.L.P.

(57) ABSTRACT

A polishing apparatus comprises a carrier having a pressing surface to be engaged with a platy workpiece to press it against a polishing surface, whereby the workpiece is polished by being subjected to a relative sliding motion relative to the polishing surface while being pressed thereagainst. The pressing surface includes a suction opening provided along an outer peripheral portion of the pressing surface for applying a vacuum to hold the workpiece on the pressing surface during polishing of the workpiece. The carrier further comprises a pressure applying opening provided inside of the suction opening for applying a pressure to press the workpiece against the polishing surface during polishing of the workpiece.

10 Claims, 5 Drawing Sheets

POLISHING APPARATUS

BACKGROUND OF THE INVENTION

The present invention relates to a polishing apparatus for polishing a workpiece such as a semiconductor wafer.

In manufacturing high-integration circuit devices and optical devices, elements of these devices, such as semiconductor wafers and optical lenses, are required to be polished to a high degree of uniformity. In recent years, in order to meet this requirement, a so-called CMP (chemical mechanical polisher) has been commonly used as a polishing apparatus for polishing semiconductor wafers. In a CMP, a semiconductor wafer is held by a wafer holder or carrier, which proceeds to lower and press the wafer against a polishing surface comprising a flexible polishing pad of a rotating turntable. The wafer is then subjected to a relative sliding motion relative to the polishing surface of the turntable while, at the same time, an alkali abrasive liquid is supplied to the polishing surface. By using this combination of mechanical and chemical polishing, highly precise polishing of a wafer can be achieved. Since in a polishing operation using a CMP, friction is generated between a wafer and a polishing surface, lateral displacement of the wafer may occur. To avoid displacement of the wafer, a retainer ring is generally employed. In FIG. 5, a retainer ring 1*a* is shown which is formed on a carrier 1 around its outer circumferential edge. In addition to a danger of lateral displacement of a wafer during polishing, there is also a danger that its circumferential edge may be overpolished if the edge is subjected to excessive pressure when the sliding motion is effected while the wafer is pressed against a polishing surface (reference is made, for example, to Unexamined Japanese Patent Application Public Disclosure No. 10-58309). Thus, as shown in FIG. 5, conventionally, a pressure ring 3 is provided outside and separate from the retainer ring l*a* on the carrier 1. During polishing, the pressure ring 3 depresses the flexible polishing pad comprising the polishing surface around the semiconductor wafer 4 by an amount sufficient to prevent the circumferential edge of the wafer to be polished from being subjected to excessive pressure and polishing during a relative sliding motion between the wafer and the polishing surface. Preferably, the pressure ring is positioned as close as possible to the circumferential edge of the wafer held on the carrier.

However, in the conventional polishing apparatus in which a retainer ring is positioned between a pressure ring and a wafer, a distance of around 2 mm exists between the pressure ring and the semiconductor wafer and it has been desired to reduce this distance.

SUMMARY OF THE INVENTION

It is an object of the present invention to provide a polishing apparatus which enables a reduction in the distance between a circumferential edge of a wafer held on a carrier and a pressure ring.

In accordance with the present invention, there is provided a polishing apparatus comprising a carrier having a pressing surface to be engaged with a platy workpiece such as a semiconductor wafer to press the workpiece against a polishing surface, whereby the workpiece is polished by being subjected to a relative sliding motion relative to the polishing surface while being pressed thereagainst, the pressing surface including a suction opening for applying a vacuum to hold the workpiece on the pressing surface during polishing of the workpiece.

The pressing surface may include a recessed portion formed at a desired position, which recessed portion has the suction opening and is communicated with a negative-pressure gas source or vacuum source provided outside the carrier, so that a vacuum can be applied to the recessed portion by the vacuum source and the platy workpiece can be securely held on the carrier under the effect of the vacuum. Preferably, the recessed portion extends along an outer peripheral portion of the pressing surface. More preferably, the recessed portion is arranged in the form of an annular groove.

Specifically, the carrier comprises a carrier body having a generally disk-like configuration and a backing plate covering the surface of the carrier body facing toward the polishing surface. The surface of the backing plate facing toward the polishing surface provides the pressing surface. This surface of the backing plate includes the recessed portion arranged in the form of an annular groove and a pressure-applying recessed portion formed radially inward of the groove. The pressure-applying recessed portion is communicated with a positive-pressure gas source or fluid pressure source provided outside the carrier. The backing plate may be made of gas-impermeable resilient material.

The present invention also provides a polishing apparatus comprising a carrier having a pressing surface for pressing a platy workpiece such as a semiconductor wafer against a polishing surface, and a pressure ring to be positioned outside and adjacent to the workpiece held by the carrier for pressing the polishing surface around the workpiece. The workpiece is polished by being subjected to a relative sliding motion relative to the polishing surface while being pressed thereagainst. The pressure ring and the carrier are capable of rotating relative to one another. Since the pressure ring is provided adjacent to the workpiece, the polishing surface can be depressed to an optimum level relative to the workpiece. Further, since the pressure ring and the carrier are capable of rotating relative to one another, it is possible to avoid a situation that when a lower surface of the pressure ring is undulating, a specific portion of the workpiece is affected by such undulation. This ensures high overall uniformity in the polishing of the workpiece.

The foregoing and other objects, features and advantages of the present invention will be apparent from the following detailed description and appended claims taken in connection with the accompanying drawings.

DETAILED DESCRIPTION OF THE INVENTION

Hereinbelow, embodiments of the present invention are described.

Figure 1:
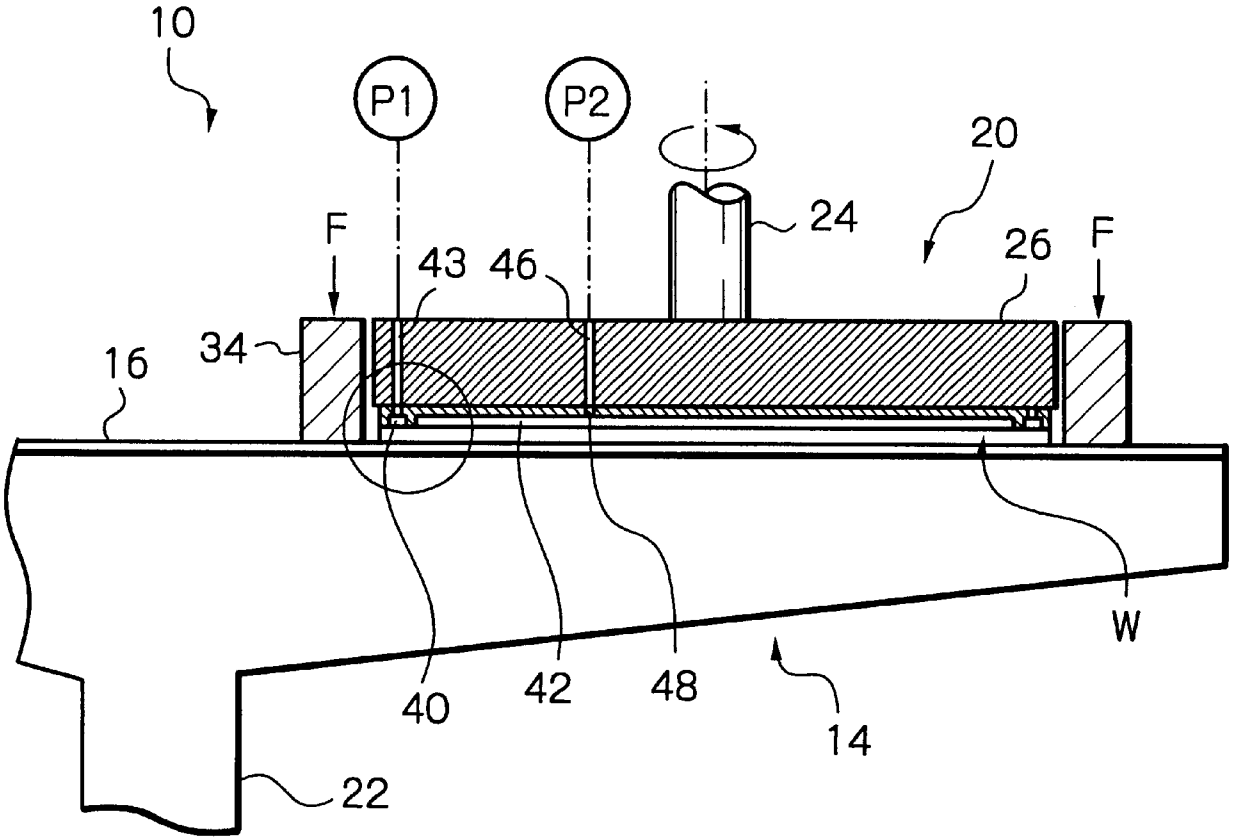
FIG. 1 is a cross-sectional side view showing a main part of a polishing apparatus of the present invention.

FIG. 1 shows an essential part of a polishing apparatus of the present invention for polishing a semiconductor wafer W. As in the case of the conventional polishing apparatus, the polishing apparatus of the present invention comprises a turntable 14 and a wafer carrier 20 adapted to hold the semiconductor wafer W and press the semiconductor wafer W against a polishing pad 16 provided on an upper surface of the turntable 14.

During polishing, the turntable 14 and the wafer carrier 20 are rotated by rotary drive shafts 22 and 24, respectively, and a relative sliding motion between the semiconductor wafer W and the polishing pad 16 is effected. At the same time, an alkali abrasive liquid is supplied from a nozzle (not shown) onto the polishing pad 16. Thus, chemical mechanical polishing of the semiconductor wafer W is conducted by means of the sliding motion in conjunction with the abrasive liquid.

As shown in FIG. 1, the wafer carrier 20 comprises a disk-like carrier body 26 connected to the rotary drive shaft 24 for rotation and a backing plate 32 covering a lower surface 30 of the carrier body 26 facing toward the turntable 14. A pressure ring 34 provided to be separate from the carrier body 26 and the backing plate 32 is provided around the wafer carrier 20 in a manner such that the pressure ring 34 is nearly in contact with an outer circumferential surface of the carrier body 26.

The surface of the backing plate 32 facing toward the turntable 14 includes a wafer-holding groove 40 in an annular form extending along an outer circumferential edge of the backing plate 32 and also includes a pressure-applying recessed portion 42 formed inward of the groove 40. The pressure-applying recessed portion 42 is in a circular form as viewed from above. The radial width (a width in a transverse direction) of the groove 40 is set to between about 5 mm and about 10 mm.

The carrier body 26 and the backing plate 32, respectively, include through-holes 43 and 44 for communication between the groove 40 and a vacuum source P1. The carrier body 26 and the backing plate 32 also include through-holes 46 and 48 for communication between the pressure-applying recessed portion 42 and a fluid pressure source P2.

The pressure ring 34 is pressed against the polishing pad 16 under a desired pressure F by means of an air cylinder 66 connected to a carrier head 52 (described later) which is provided above the wafer carrier 20 for supporting the wafer carrier 20.

As the polishing pad 16, it is preferred to use IC1000, IC1000-SUBA400 or Politex (each supplied from RODEL NITTA). An abrasive plate comprising abrasive particles fixed by using a binder may be used; instead of the polishing pad. The backing plate 32 is preferably made of a gas-impermeable elastic material, such as a silicone rubber, a neoprene rubber, a urethane rubber or a fluoro rubber.

By using the above-mentioned polishing apparatus, polishing of semiconductor wafers is conducted as follows. First, the wafer carrier 20 is moved outward of the turntable 14 and positioned above the wafer to be polished. A negative pressure (a vacuum) is applied to the groove 40 and/or the pressure-applying recessed portion 42; to thereby hold the wafer on the wafer carrier 20 under the effect of the vacuum and transfer the wafer to the polishing pad 16 on the turntable 14. Subsequently, the turntable 14 and the wafer carrier 20 are rotated by the rotary drive shaft 22 and the rotary drive shaft 24, respectively, and an abrasive liquid is supplied from the nozzle (not shown) onto the polishing pad 16 and polishing of the wafer is started. During polishing, a pressure-applying fluid is supplied to the pressure-applying recessed portion 42, to thereby press the semiconductor wafer W against the polishing pad 16, while the negative pressure is applied to the groove 40, to thereby securely hold the semiconductor wafer W on the backing plate 32 and hence the wafer carrier 20. The strength of the vacuum force applied to the wafer during polishing should be sufficient to prevent lateral displacement of the wafer from the wafer carrier 20, which would otherwise occur due to a lateral frictional force generated between the polishing pad 16 and the wafer during polishing, whereby the wafer is securely held. Specifically, the negative pressure applied to the groove 40 is set to between about −50 Kpa and about −90 Kpa and the pressure applied to the pressure-applying recessed portion 42 is set to between 0 Kpa and 19.6 Kpa (between 0 g/cm$^2$ and 200 g/cm$^2$). The pressure of the wafer carrier 20 applied to the wafer is set to between about 4.9 Kpa and about 29.4 Kpa (between about 50 g/cm$^2$ and about 300 g/cm$^2$). The pressure of the pressure ring 34 applied to the polishing pad 16 is set to between 0 Kpa and 49 Kpa (between 0 g/cm$^2$ and 500 g/cm$^2$).

Figure 2:
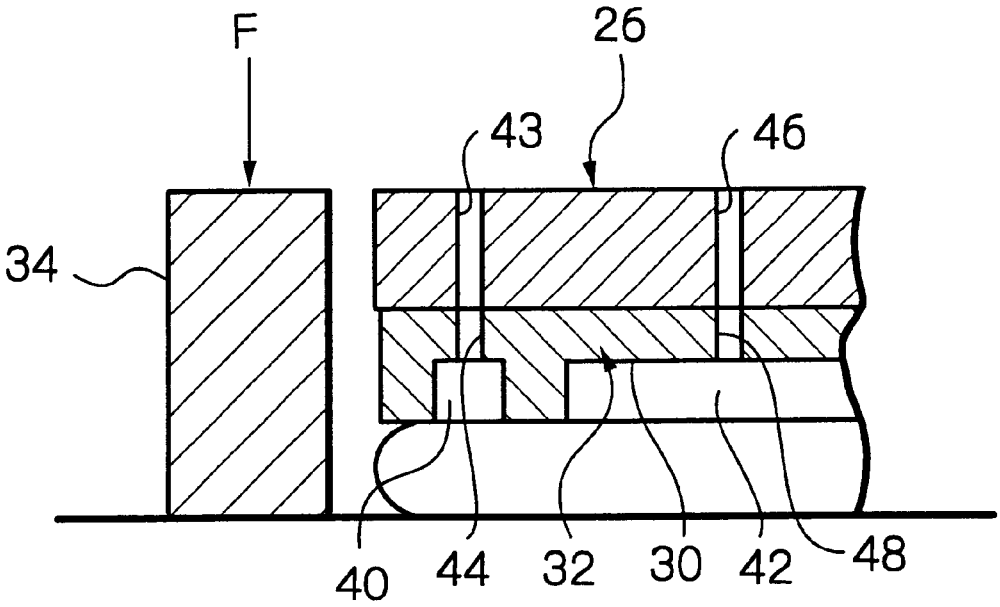
FIG. 2 is an enlarged cross-sectional side view showing an essential part of a carrier body of the polishing apparatus of FIG. 1.
Figure 3:
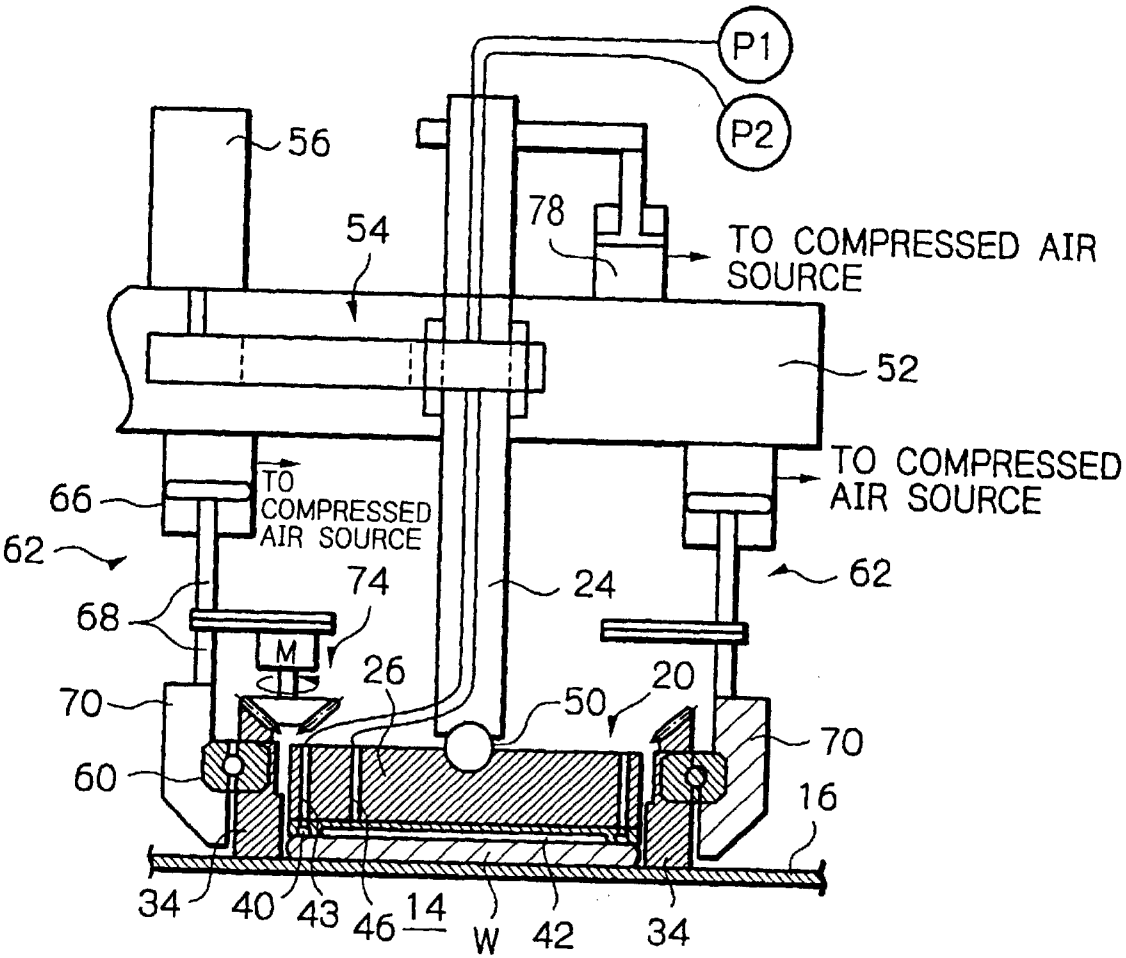
FIG. 3 is a cross-sectional side view showing a polishing apparatus according to an embodiment of the present invention.

FIG. 3 shows an illustrative example of the polishing apparatus shown in FIGS. 1 and 2. This polishing apparatus comprises the turntable 14 having the polishing pad 16 provided thereon and the wafer carrier 20 for supporting the semiconductor wafer W. The wafer carrier 20 comprises the carrier body 26 and the backing plate 32. The backing plate 32 includes the groove 40 and the pressure-applying recessed portion 42. The pressure ring 34 is provided around the wafer carrier 20.

In the present invention, the groove 40 is formed for holding a wafer by application of a vacuum during polishing. Since a groove having a predetermined width such as the groove 40 is formed along the outer circumferential edge of the backing plate 32, an area for holding a wafer under the effect of vacuum is markedly larger than the total of areas for holding a wafer obtained by small vacuum openings, which are discretely arranged over a back surface of a wafer as is the case in a conventional wafer carrier. Therefore, a large vacuum force can be applied to the wafer. Further, an effect of leakage of vacuum can be suppressed due to the substantial volume of the space in the groove. Consequently, the wafer can be securely held and there is no need to use a retainer ring.

The rotary drive shaft 24 is connected to the wafer carrier 20 by means of a universal joint 50. The rotary drive shaft 24 is adapted to rotated by a motor 56, which is rotatably supported by the carrier head 52 and connected to the rotary drive shaft 24 through a driving belt 54.

The pressure ring 34 is connected through a radial bearing 60 to a piston-cylinder apparatus 62 provided in the carrier head 52. The piston-cylinder apparatus 62 comprises an air cylinder 66 fixed to the carrier head 52 and a piston rod 68 extending downward from the air cylinder 66. A connecting member 70 at a lower end of the piston rod 68 is connected to the pressure ring 34 through the radial bearing 60 and applies the desired pressure F exerted by the air cylinder 66 to the pressure ring 34. The pressure ring 34 is capable of rotation relative to the connecting member 70 through the radial bearing 60. Further, the pressure ring 34 is connected through a bevel gear 74 to a motor M attached to an intermediate portion of the piston rod 68, and adapted to be rotated relative to the connecting member 70 by the motor M. That is, the pressure ring 34 is capable of rotating independently of the wafer carrier 20. For example, the wafer carrier 20 and the pressure ring 34 can be rotated at different respective speeds by setting the rotation speed of the wafer carrier to 60 rpm, and setting the rotation speed of the pressure ring to 61 rpm. When the wafer carrier 20 and the pressure ring 34 are rotated at the same speed, the positional relationship between the semiconductor wafer W held by the wafer carrier 20 and the pressure ring 34 does not change and therefore, if a lower surface of the pressure ring 34 is undulating, such undulation will adversely affect polishing of the wafer. This can be prevented by rotating the wafer carrier 20 and the pressure ring 34 at different respective speeds. Since the lower surface of the pressure ring 34 is susceptible to wear, it is preferred that the pressure ring 34 be rotated in the same direction as the wafer carrier 20 at a speed slightly lower than that of the wafer carrier 20. In the present invention, relative rotation between the pressure ring and the wafer carrier is made possible because, as mentioned above, during polishing, a wafer can be securely held on the wafer carrier 20 by application of a vacuum, and contact between the wafer and the pressure ring 34 can be prevented. Reference numeral 78 denotes a piston-cylinder apparatus attached to the carrier head 52, which is used for moving the rotary drive shaft 24 in a vertical direction relative to the carrier head 52.

Figure 4:
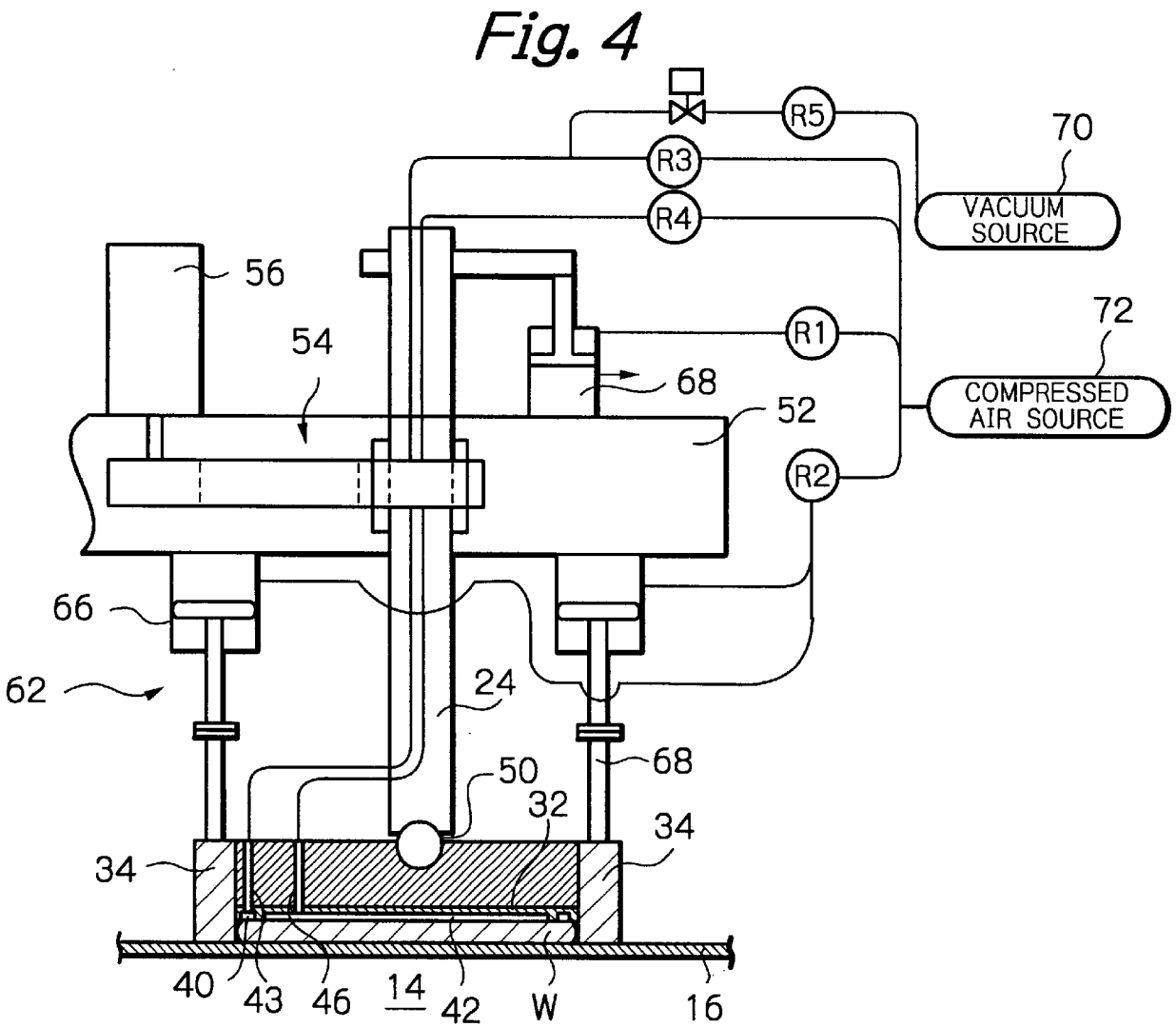
FIG. 4 is a cross-sectional side view showing a polishing apparatus according to another embodiment of the present invention.
Figure 5:
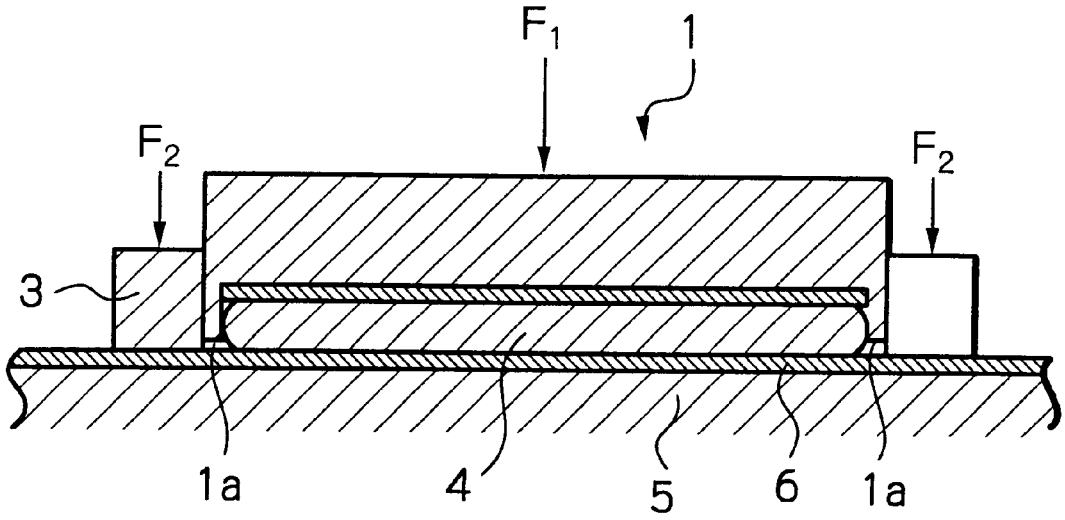
FIG. 5 is a cross-sectional side view showing a wafer carrier of a conventional polishing apparatus.

FIG. 4 is a modified example of the polishing apparatus of FIG. 3. In this example, relative rotation between the pressure ring 34 and the wafer carrier 20 is not conducted. The pressure ring 34 is connected to the wafer carrier 20 in a manner such that the pressure ring 34 is capable of vertical movement relative to the wafer carrier 20. Therefore, members for rotating the pressure ring 34, such as the motor shown in FIG. 3, are not provided. In FIG. 4, valves R3 to R5 are provided in passages for connecting the groove 40 and the pressure-applying recessed portion 42 in the backing plate 32 of the wafer carrier 20 with a vacuum source 80 and a compressed air source 72. The pressures in the groove 40 and the pressure-applying recessed portion 42 are appropriately controlled by controlling these valves.

The polishing apparatus of the present invention is arranged as mentioned above. During polishing, a workpiece such as the semiconductor wafer W is pressed against the polishing pad 16 by means of a pressure-applying fluid supplied to the pressure-applying recessed portion 42, while a vacuum is applied to the groove 40 so as to securely hold the semiconductor wafer W on the wafer carrier 20. Therefore, differing from the conventional polishing apparatus, there is no need to provide the retainer ring in the wafer carrier. Since no retainer ring is provided, the distance between the pressure ring 34 and the workpiece can be reduced by the distance corresponding to the retainer ring. Therefore, the polishing pad 16 which is engaged with the workpiece during polishing can be depressed to the same level as the surface of the workpiece to be polished, thus making it possible to avoid a situation that an edge of the workpiece is subject to excessive polishing. In one embodiment of the present invention, the distance between an inner edge of the pressure ring 34 and an outer circumferential edge of the semiconductor wafer, which is at least 2 mm in the conventional polishing apparatus, is reduced to 0.5 mm.

Further, since contact between the wafer and the pressure ring 34 during polishing can be prevented, the pressure ring 34 can be rotated relative to the wafer (or the wafer carrier). This avoids a situation such that only a specific portion of the wafer is affected by undulation of a lower surface of the pressure ring 34 during polishing.

What is claimed is:

1. A polishing apparatus comprising a carrier having a pressing surface to be engaged with a platy workpiece to press the workpiece against a polishing surface, whereby the workpiece is polished by being subjected to a relative sliding motion relative to the polishing surface while being pressed thereagainst, the pressing surface including a suction opening for applying a vacuum to hold the workpiece on the pressing surface during polishing of the workpiece, wherein the pressing surface includes a recessed portion having an opening defined in the pressing surface which provides the suction opening, the recessed portion being communicated with a vacuum source provided outside the carrier, and wherein the carrier comprises:

a carrier body having a generally disk-like configuration, the carrier body having a surface facing toward the polishing surface; and a backing plate covering said surface of the carrier body, the backing plate having a surface facing toward the polishing surface, said surface of the backing plate providing the pressing surface, said surface of the backing plate including the recessed portion arranged in the form of an annular groove and a pressure-applying recessed portion formed radially inward of the groove, the pressure-applying recessed portion being communicated with a fluid pressure source provided outside the carrier.

2. A polishing apparatus comprising a carrier having a pressing surface to be engaged with a platy workpiece to press the workpiece against a polishing surface, whereby the workpiece is polished by being subjected to a relative sliding motion relative to the polishing surface while being pressed thereagainst, the pressing surface including a suction opening for applying a vacuum to hold the workpiece on the pressing surface during polishing of the workpiece, wherein a pressure ring separate from the carrier is provided around the carrier, the pressure ring being adapted to press the polishing surface around the workpiece held by the carrier.

3. A polishing apparatus comprising:

a carrier having a pressing surface to be engaged with a platy workpiece to press the workpiece against a polishing surface, whereby the workpiece is polished by being subjected to a relative sliding motion relative to the polishing surface while being pressed thereagainst, the pressing surface including a suction opening provided in an outer peripheral portion of the pressing surface and a pressure-applying opening provided radially inside the suction opening, wherein the pressing surface includes an annular groove provided along the outer peripheral portion of the pressing surface, and the annular groove has an annular opening defined in the pressing surface which provides the suction opening.

4. The polishing apparatus according to claim 3, wherein the carrier comprises:

a carrier body having a generally disk-like configuration, the carrier body having a surface facing toward the polishing surface; and a backing plate covering said surface of the carrier body, the backing plate having a surface facing toward the polishing surface, said surface of the backing plate providing the pressing surface, said surface of the backing plate including the suction opening and the pressure-applying opening, the backing plate being made of gas-impermeable elastic material.

5. A polishing apparatus comprising:

a carrier having a pressing surface to be engaged with a platy workpiece to press the workpiece against a polishing surface, whereby the workpiece is polished by being subjected to a relative sliding motion relative to the polishing surface while being pressed thereagainst, the pressing surface including a suction opening provided in an outer peripheral portion of the pressing surface and a pressure-applying opening provided radially inside the suction opening, wherein the carrier comprises:

a pressure ring to be positioned adjacent to and outside the workpiece held by the carrier for pressing the polishing surface around the workpiece during polishing of the workpiece, the pressure ring and the carrier being capable of rotating relative to one another.

6. A polishing apparatus comprising:

a carrier having a pressing surface to be engaged with a platy workpiece to press the workpiece against a polishing surface, whereby the workpiece is polished by being subjected to a relative sliding motion relative to the polishing surface while being pressed thereagainst, the pressing surface including a suction opening provided in an outer peripheral portion of the pressing surface and a pressure-applying opening provided radially inside the suction opening, the suction opening being adapted to be fluidly connected to a negative-pressure gas source to apply a negative-pressure to hold the workpiece on the pressing surface during polishing of the workpiece, the pressure-applying opening being adapted to fluidly connected to a positive-pressure gas source to supply a positive pressure fluid to press the workpiece against the pressing surface during polishing of the workpiece, wherein the pressing surface includes an annular groove provided along the outer peripheral portion of the pressing surface, and the annular groove has an annular opening defined in the pressing surface which provides the suction opening.

7. The polishing apparatus according to claim 6, wherein the carrier comprises:

a carrier body having a generally disk-like configuration, the carrier body having a surface facing toward the polishing surface; and a backing plate covering said surface of the carrier body, the backing plate having a surface facing toward the polishing surface, said surface of the backing plate providing the pressing surface, said surface of the backing plate including the suction opening and the pressure-applying opening, the backing plate being made of gas-impermeable elastic material.

8. A polishing apparatus comprising:

a carrier having a pressing surface to be engaged with a platy workpiece to press the workpiece against a polishing surface, whereby the workpiece is polished by being subjected to a relative sliding motion relative to the polishing surface while being pressed thereagainst, the pressing surface including a suction opening provided in an outer peripheral portion of the pressing surface and a pressure-applying opening provided radially inside the suction opening, the suction opening being adapted to be fluidly connected to a negative-pressure gas source to apply a negative-pressure to hold the workpiece on the pressing surface during polishing of the workpiece, the pressure-applying opening being adapted to fluidly connected to a positive-pressure gas source to supply a positive pressure fluid to press the workpiece against the pressing surface during polishing of the workpiece, wherein the carrier comprises:

a pressure ring to be positioned adjacent to and outside the workpiece held by the carrier for pressing the polishing surface around the workpiece during polishing of the workpiece, the pressure ring and the carrier being capable of rotating relative to one another.

9. A polishing apparatus comprising:

a carrier having a pressing surface to be engaged with a platy workpiece to press the workpiece against a polishing surface, whereby the workpiece is polished by being subjected to a relative sliding motion relative to the polishing surface while being pressed thereagainst, said carrier comprising a carrier body having a generally disk-like configuration, the carrier body having a surface facing toward the polishing surface, and a backing plate made of gas-impermeable elastic material and covering said surface of the carrier body, the backing plate having a surface facing toward the polishing surface, said surface of the backing plate providing the pressing surface, said surface of the backing plate including a suction opening provided in an outer peripheral portion of the surface of the backing plate and a pressure-applying opening radially inside the suction opening, wherein said surface of the backing plate includes an annular groove provided along the outer peripheral portion thereof, and the annular groove has an annular opening defined in the surface of the backing plate which provides the suction opening.

10. A polishing apparatus comprising:

a carrier having a pressing surface to be engaged with a platy workpiece to press the workpiece against a polishing surface, whereby the workpiece is polished by being subjected to a relative sliding motion relative to the polishing surface while being pressed thereagainst, said carrier comprising a carrier body having a generally disk-like configuration, the carrier body having a surface facing toward the polishing surface, and a backing plate made of gas-impermeable elastic material and covering said surface of the carrier body, the backing plate having a surface facing toward the polishing surface, said surface of the backing plate providing the pressing surface, said surface of the backing plate including a suction opening provided in an outer peripheral portion of the surface of the backing plate and a pressure-applying opening radially inside the suction opening, wherein the carrier comprises:

a pressure ring to be positioned adjacent to and outside the workpiece held by the carrier for pressing the polishing surface around the workpiece during polishing of the workpiece, the pressure ring and the carrier being capable of rotating relative to one another.

* * * * *